US005715740A

United States Patent [19]

Sims

[11] Patent Number: 5,715,740

[45] Date of Patent: Feb. 10, 1998

[54] COMBINED PISTON ROD ALIGNMENT AND SEALING ASSEMBLY FOR FLUID ACTUATOR CYLINDERS

[76] Inventor: James O. Sims, 1100 Brooks Dr., Decatur, Ala. 35601

[21] Appl. No.: 701,684

[22] Filed: Aug. 22, 1996

[51] Int. Cl.[6] ..... F01B 29/00

[52] U.S. Cl. ..... 92/128; 92/168

[58] Field of Search ..... 92/128, 165 R, 92/168

[56] References Cited

U.S. PATENT DOCUMENTS

| | | | |
|---|---|---|---|
| 3,334,773 | 8/1967 | Bimba | 92/165 R |
| 3,559,540 | 2/1971 | Sheldon | 92/168 X |
| 4,085,661 | 4/1978 | Schriever | 92/128 X |
| 4,211,151 | 7/1980 | Wallischeck | 92/165 R X |
| 4,238,009 | 12/1980 | Wossner et al. | 92/128 X |
| 4,771,678 | 9/1988 | Walker | 92/128 |
| 4,976,192 | 12/1990 | Grach | 92/168 X |

*Primary Examiner*—Hoang Nguyen

*Attorney, Agent, or Firm*—C. A. Phillips; Harold W. Hilton

[57] ABSTRACT

A fluid actuator having a housing (cylinder) which encloses a piston actuated piston rod having at least one end extending through an opening in an end cylinder closure member secured in at least one end of the cylinder. The closure member is insertable into at least one end of the cylinder for sealing engagement therewith and is provided with a tapered seat which abuts against a similarly tapered seat provided in the cylinder to provide a metal-to-metal seal which also serves as an alignment mechanism for the extending piston rod.

14 Claims, 4 Drawing Sheets

COMBINED PISTON ROD ALIGNMENT AND SEALING ASSEMBLY FOR FLUID ACTUATOR CYLINDERS

FIELD OF THE INVENTION

This invention relates generally to fluid actuators and more particularly to a tapered end closure member for fluid actuators which serves as a cylinder end sealing member and as an alignment means for a piston rod mounted in and extending out of the housing of the fluid actuator.

BACKGROUND OF THE INVENTION

Typical fluid actuator assemblies include a cylinder or housing in which a piston and piston rod are reciprocally mounted. The ends of the housing are sealed by closure members to contain a pressurized fluid in the housing. The actuator may be single-acting and be provided with a single piston rod which extends through an opening in one closure member or double-acting wherein piston rods extend through openings in both closure members of the fluid cylinder assembly.

The closure member typically includes a gland portion which extends into the cylinder and is provided with O-ring seals around the outer peripheral surface. The outer peripheral surface of the gland portion is typically provided with a diameter which is smaller than the internal surface of the cylinder wall so that the gland portion may be inserted into the interior of the cylinder. The outer peripheral surface of the gland portion, therefore, does not contact the inner surface of the cylinder. However, the outer surface of the O-rings do contact the inner surface of the cylinder; and because the O-ring are typically elastomeric and are required to be subjected to external fluid pressure which is directed through the clearance between the outer surface of the gland portion and the internal surface of the cylinder, the O-rings tend to be blown.

SUMMARY OF THE INVENTION

To overcome the above-noted problems, the present invention provides a fluid actuator having a cylinder provided with a pair of end closure members having a tapered external surface or seat which is disposed for metal-to-metal contact with a complimentary tapered internal surface provided on the inner surface of the end portions of the cylinders.

It is, therefore, an object of the present invention to provide a fluid actuator with end closure members which provides for metal-to-metal sealing between the closure member and the inner surface of the cylinder.

It is a further object of the present invention to provide such a fluid actuator wherein the metal-to-metal sealing is accomplished by providing complimentary mating tapered surfaces or seats on the closure members and the end portions of the cylinder.

It is yet another object of the present invention to provide an end closure assembly for fluid actuators which provides for automatic alignment of a piston rod in the fluid actuator cylinder responsive to secured relation of the closure member to the fluid actuator.

DESCRIPTION OF THE PREFERRED EMBODIMENT

Figure 1:
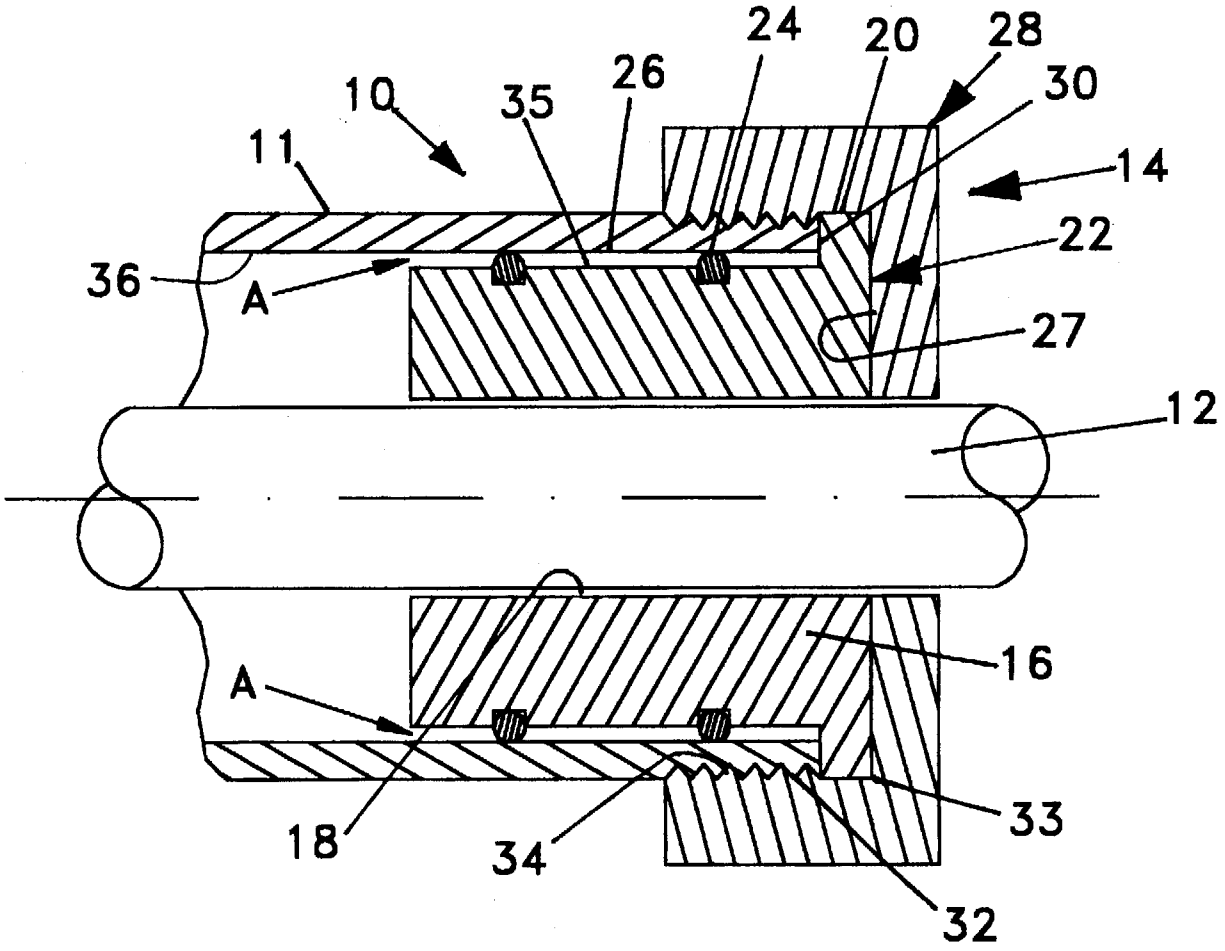
FIG. 1 (PRIOR ART)
FIG. 1 is a partial sectional view which illustrates a typical (prior art) end closure member of a fluid actuator.

FIG. 1 is a partial sectional view of a typical (prior art) piston/cylinder assembly 10 including a cylinder or housing 11 having a piston rod 12 reciprocally mounted therein and extending through an end seal assembly 14. Seal assembly 14 is shown to be mounted on an end of housing 11 and includes an annular member 16 having a central opening 18 through which rod 12 extends and an annular flanged portion 20 provided on the outer end 22 thereof. O-ring seals 24 are positioned in grooves provided around the outer peripheral surface 26 of member 16. The flanged portion 20 is snugly engaged between the inner surface 27 of an annular collar 28 and the distal end 30 of cylinder 11. Annular collar 28 may be secured to the end of cylinder 11 by internal threads 32 which threadingly engage external threads 34 provided adjacent to the end 33 of cylinder 11.

Figure 2:
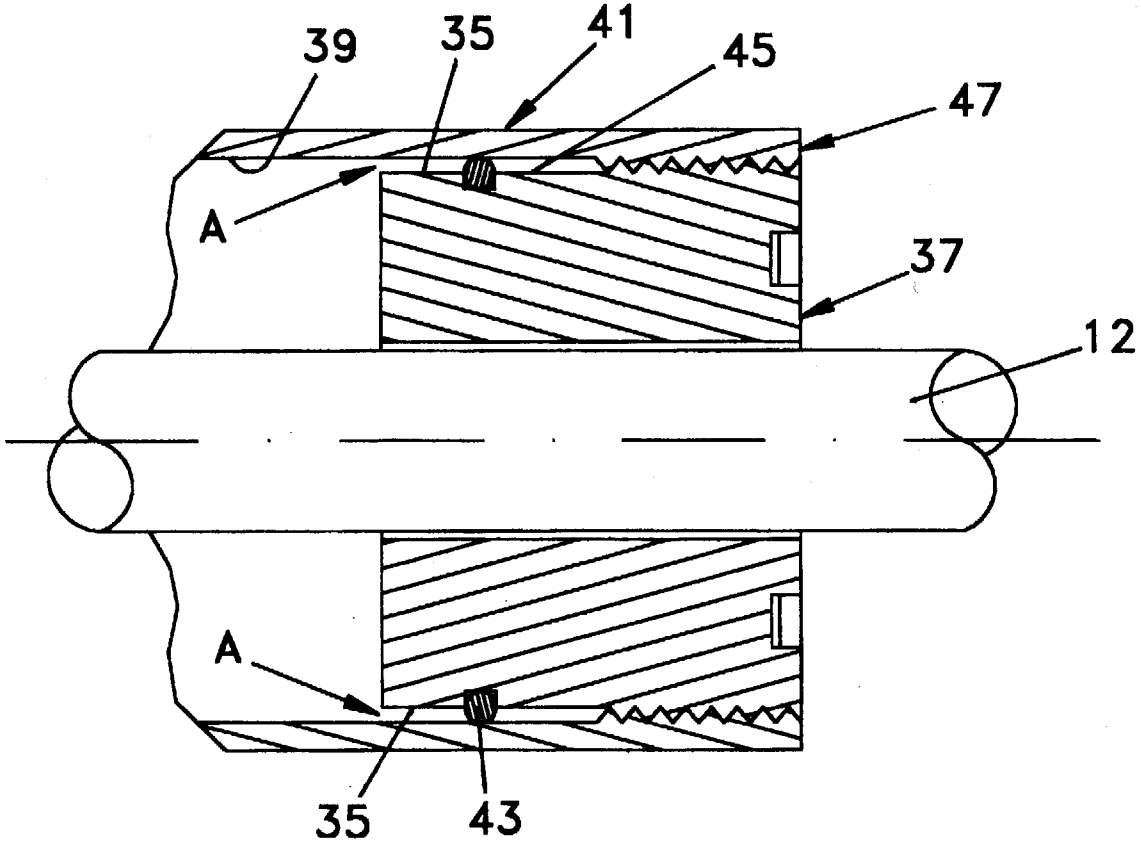
FIG. 2 (PRIOR ART)
FIG. 2 is a partial elevational view which illustrates another typical (prior art) end closure member of a fluid actuator.

FIG. 2 is a partial sectional view of another type of prior art end closure member for a fluid actuator. This prior art arrangement is similar to the device of FIG. 1 in that a clearance A still exists between the outer surface 35 of a closure member 37 and the internal surface 39 of a cylinder 41, and, therefore, pressurized fluid is allowed to be directed through this clearance (as indicated by arrows A) to O-rings 43 mounted on the periphery of a cylindrical portion 45 of closure member 37, thereby tending to blow or deform the O-rings. In this arrangement of FIG. 2, closure member 37 is threadably secured in a threaded end 47 of cylinder 41.

By the above-described arrangement, it can be readily seen that pressurized fluids in the cylinder tend to exert a force (as shown by arrows A) on the O-ring seals through the clearance typically provided between the annular portion of the end closure member and the inner surface of the cylinder. Such force causes the seals to be blown. The clearance exists because the outer cylindrical surface of the end closure member is smaller in diameter than the internal surface (bore) of the cylinder to permit the outer peripheral surface of the O-rings to extend outwardly beyond the outer surface of the end closure member for engagement with the inner surface of the cylinder and to permit insertion of the gland (annular cylindrical portion) of the end closure member into the cylinder. Additionally, as the O-ring seals wear, the annular sealing member tends to "cock" in the cylinder, causing the piston rod to become misaligned. Such misalignment in the area of the end sealing member causes a greater amount of misalignment of the piston in the cylinder, resulting in excessive wear to the inner surface of the cylinder and to the outer peripheral surface of the piston and leakage between the inner surface of the cylinder and the outer surface of the gland portion of the gland member.

To overcome the above-noted problems, the present invention provides an end closure member with a tapered external surface or seat which is disposed for metal-to-metal contact with a complimentary tapered surface or seat provided on the inner end portion of the cylinder. The provision of the mating tapered surfaces assures that no internal fluidic pressure is exerted on the O-rings positioned around the gland portion of the closure member and also insures that any piston rod extending through the closure member is automatically properly aligned in the cylinder responsive to the end closure member being secured to the cylinder.

Figure 3:
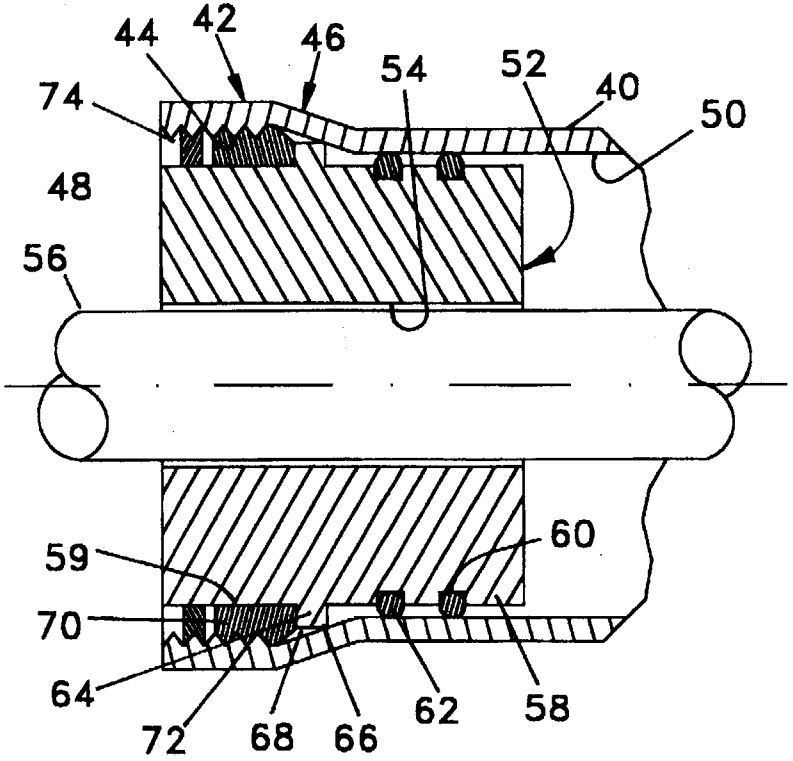
FIG. 3 is a partial sectional view which illustrates a fluid actuator cylinder which utilizes one embodiment of a tapered end closure and piston rod alignment and sealing member of the present invention.
Figure 4:
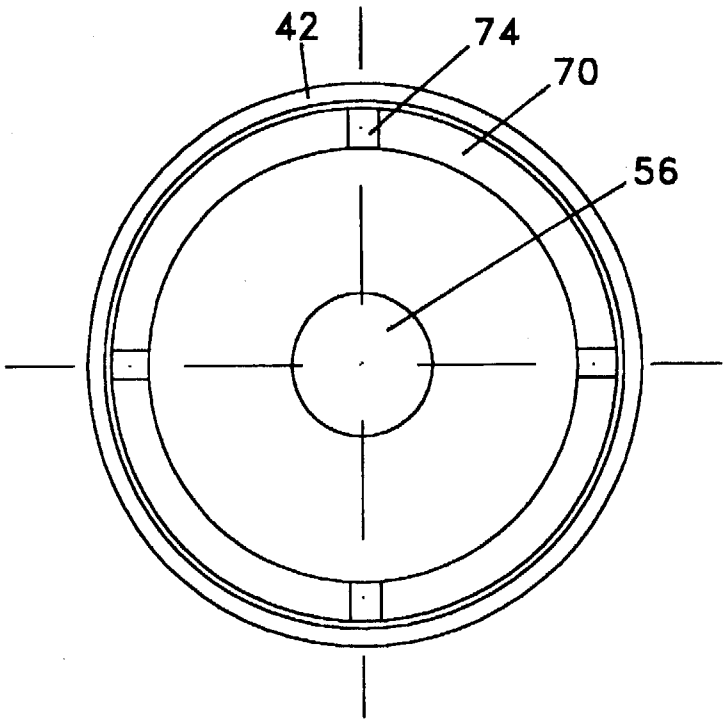
FIG. 4 is an end view of the assembly of FIG. 3.

As seen in FIG. 3, the present invention includes a cylinder 40 which is provided with an enlarged end portion 42 having internal threads 44 thereon, a tapered portion 46 having an internal tapered surface 48, and an internal cylinder bore surface 50. An annular end seal member 52 is mounted in end portion 42 of cylinder 40 and is provided on its outer peripheral surface with a central opening 54 through which a piston rod 56 extends. Rod 56 has one end secured to a piston (not shown) which is mounted in cylinder 40 for reciprocal movement therein, as is well known in the art.

End seal member 52 includes forward outer annular surface 58 and an aft outer surface 59. Forward annular surface 58 of member 52 is provided with grooves 60 to receive O-ring seals 62 therein. An annular shoulder 64 is provided on the seal member 52. Shoulder 64 is provided on its outer peripheral surface with a tapered surface 66 which is tapered at substantially the same angle as inner tapered surface 48 of cylinder 40. The shoulder 64 forms an annular space 68 between the aft outer surface 59 of seal member 52 and the threads 44 provided on the internal surface of enlarged portion 42 of cylinder 40. A retaining ring 70 having external threads 72 for threaded engagement with internal threads 44 of cylinder 40 is positioned in annular space 68 and includes slots 74 into which a tool (spanner wrench or the like) may be inserted for rotation of the retainer ring into abutting relation with member 52 to axially move the seal member 52 into the cylinder for snug-fitting engagement of the tapered surface 66 of shoulder 64 against the tapered surface 48 of cylinder 40. Member 52 does not rotate during this axial movement.

Figure 5:
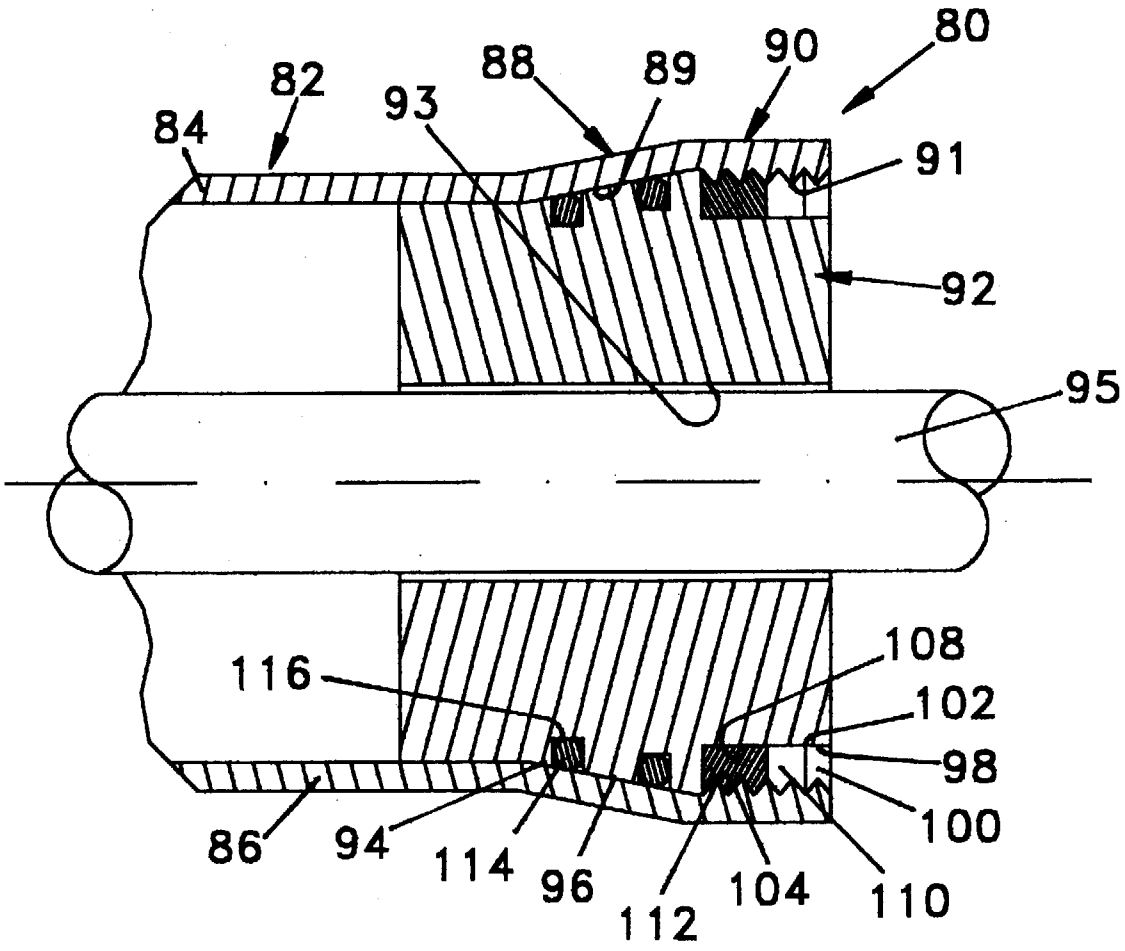
FIG. 5 is a view similar to FIG. 3 illustrating another embodiment of the present invention.

Another embodiment of the present invention is illustrated in FIG. 5, which is a partial sectional view of one end 80 of a fluid actuator assembly. As seen in FIG. 5, a fluid actuator housing 82 includes a cylinder 84 having a cylindrical constant diameter portion 86, an intermediate tapered seat portion 88 having an internally tapered surface 89 and an enlarged portion 90 having internal threads 91 thereon. An end closure member 92 is mounted in end 80 of cylinder 84 and is shown to be provided with a central opening 93 having a piston rod 95 extending therethrough. The piston rod is secured to a piston (not shown) for reciprocal movement of the piston rod, as is well known in the art. Member 92 includes a forward annular surface 94, an intermediate tapered seat portion 96, and an aft reduced diameter portion 98. An annular space 100 is formed between the outer annular surface 102 of reduced diameter portion 98 and internal threads 104 formed on the inner surface of enlarged internally threaded cylinder portion 90. A retaining ring 108 having slots 110 and external threads 112 thereon is provided to snugly draw the external tapered surface or seat 96 against the internal tapered surface or seat 89 of the cylinder. Slots 110 permit the ring to be grasped by a tool (such as a spanner wrench) for rotation of the ring for threaded engagement of the threads 112 of the ring and the threads 91 of cylinder 84. Forward annular shoulder 94 is provided on member 92 to serve as a guide for the insertion of member 92 into the end portion of the cylinder, if desired. A plurality of O-ring seals 114 are positioned in slots 116 provided on the tapered seat of member 92 to serve as an additional sealing means.

It is to be understood that the end 80 of the cylinder need not be enlarged as shown, and the tapered seat 89 may be machined in the internal surface of the ends of a cylinder if the cylinder is provided with a wall thickness which will permit the seat to be machined therein.

It is also to be understood that the end closure seal member is readily insertable into the end of the cylinder and substantially press fit therein responsive to rotation of the retaining member in the threaded portion of the cylinder to threadably secure the retaining member to the cylinder. The closure member does not rotate, and, therefore, there is no chance of the O-ring "rolling up" and being deformed as is in the case where the end sealing member must be rotated for secured relation with the cylinder.

As can be seen from the above description and the accompanying drawings, an end closure member for high pressure fluid actuators is described and shown, which provides for press-fit, metal-to-metal contact between complimentary tapered seating surfaces of the fluid actuator cylinder and the end closure members to prevent pressurized fluid from escaping by the contacting sealing surfaces and also serves as an alignment mechanism for a piston rod extending through the end closure member.

I claim:

1. A fluid actuator comprising:

a housing provided with a cylindrical bore portion, at least one internally threaded end portion, and an internally tapered seat portion disposed intermediate said threaded portion and said cylindrical portion;

an end closure member disposed for mounting within said at least one end portion, said end closure member having a pair of tapered seat portions which are substantially the same as said tapered seat portion of said cylinder; and a single member rotatable carried in said internally threaded end portion for securing said end closure member in said one end of said cylinder, said single member disposed for exerting a force on said end closure member without substantially rotating said end closure member in said cylinder, said force being an axial force which moves said tapered seat portions of said closure member in press fitting relation against said tapered seat of said cylinder to provide a fluidic seal between said tapered surfaces.

2. A fluid actuator as in claim 1 wherein said internally threaded end portion is provided with an internal diameter which is larger than the internal diameter of said bore portion, and said tapered seat portion of said cylinder tapers inwardly from said threaded portion to said cylindrical bore portion.

3. A fluidic actuator as in claim 1 wherein said end closure member includes a forward cylindrical end portion, an aft end portion, and a flanged intermediate portion, said forward cylindrical end portion disposed for extending into said cylindrical bore portion of said housing, said aft end portion disposed for positioning in said threaded end portion, and said flanged portion having said tapered seat portion on the periphery thereof.

4. A fluidic actuator as in claim 1 including a piston actuated piston rod mounted in said housing, said end closure member having a central opening through which said piston rod extends, and said single member is an annular member having threads on the outer periphery thereof, said threads of said annular member disposed for threaded engagement in said threaded end portion of said cylinder and for abutting relation with said end closure member responsive to rotation of said annular member in said threaded end portion of said cylinder, whereby said tapered seats are brought into mating, sealing relation, and whereby said rod is automatically axially aligned in said cylinder responsive to the secured relation of said end sealing member in said one end of said cylinder.

5. A fluidic actuator as in claim 4 wherein said end closure member is provided with a plurality of O-ring receiving grooves around the periphery of said forward portion thereof.

6. A fluid actuator as in claim 5 wherein said threaded annular member is provided with means thereon to permit gripped engagement thereof for rotation of said annular member.

7. A fluid actuator as in claim 1 wherein said end closure member is provided with an aft reduced diameter portion, and said tapered seat portions are disposed adjacent to said reduced diameter portion and tapered inwardly therefrom.

8. A fluid actuator as set forth in claim 7 wherein said end closure member is provided with guide means extending from said tapered seat portion for insertion into said bore portion of said cylinder for guiding said end closure member into said cylinder for the seated, engaged relation of said tapered seat of said closure member with said tapered seat of said cylinder.

9. A fluid actuator as in claim 7 wherein the first of said tapered seat portions of said closure member is provided with at least one O-ring receiving groove around the periphery thereof.

10. A fluid actuator as in claim 7 including a piston actuated piston rod mounted in said housing, said end closure member having a central opening through which said piston rod extends, and said retaining means is an annular member having threads on the outer periphery thereof, said threads of said annular member disposed for threaded engagement in said threaded end portion of said cylinder and for abutting relation with said end closure member responsive to rotation of said annular member in said threaded end portion of said cylinder, whereby said tapered seats are brought into mating, sealing relation, and whereby said rod is automatically aligned in said cylinder responsive to the secured relation of said sealing member in said one end of said cylinder.

11. A fluid actuator as in claim 10 wherein said threaded annular member is provided with means thereon to permit gripped engagement thereof for rotation of said annular member.

12. A fluid actuator having a combined piston rod alignment and end sealing assembly comprising:

a housing having an internal cylindrical surface and at least one enlarged end having a tapered internal surface adjacent to said internally cylindrical surface;

a piston actuated piston rod mounted in said housing;

a sealing and alignment member having a pair of seats which are substantially similarly tapered to said tapered internal surface of said cylinder and a central opening through which said piston rod extends; and securing means for securing and positioning said pair of tapered seats of said sealing and alignment member snugly against said tapered surface of said cylinder, whereby the end of said cylinder is sealed against leakage, and whereby said piston rod is axially aligned in said housing.

13. A fluid actuator as in claim 12 including at least one O-ring receiving groove provided on the periphery of said tapered surface of said sealing and alignment member.

14. A fluid actuator as in claim 12 wherein said sealing and alignment member is provided with an annular shoulder having one of said tapered seats thereon, said one of said tapered seats serving as a guide for positioning said sealing and alignment member in said cylinder.

* * * * *